US006425337B1

(12) United States Patent
Knaak

(10) Patent No.: US 6,425,337 B1
(45) Date of Patent: Jul. 30, 2002

(54) SAIL BATTENS

(76) Inventor: Rudiger Knaak, Heinestrasse 17, D-41464 Neuss (DE)

( * ) Notice: Subject to any disclaimer, the term of this patent is extended or adjusted under 35 U.S.C. 154(b) by 0 days.

(21) Appl. No.: 09/180,345

(22) PCT Filed: May 5, 1997

(86) PCT No.: PCT/EP97/02281

§ 371 (c)(1),
(2), (4) Date: Sep. 13, 1999

(87) PCT Pub. No.: WO97/42076

PCT Pub. Date: Nov. 13, 1997

(30) Foreign Application Priority Data

May 8, 1996 (DE) ..... 196 18 339

(51) Int. Cl.[7] ..... B63H 9/04
(52) U.S. Cl. ..... 114/102.24
(58) Field of Search ..... 114/102.1, 102.24, 114/102.22, 102.12

(56) References Cited

U.S. PATENT DOCUMENTS 2,378,877 A 6/1945 Waller

FOREIGN PATENT DOCUMENTS

| | | |
|---|---|---|
| DE | 3540646 | 5/1986 |
| DE | 4312803 | * 10/1994 |
| JP | 350098 | * 4/1991 |

* cited by examiner

*Primary Examiner*—Ed Swinehart
(74) *Attorney, Agent, or Firm*—Wall Marjama & Bilinski LLP

(57) ABSTRACT

The invention relates to sail battens comprising tubular batten rods (1) which meet each other in a loose manner and in which tubular inner rods (2) of the same length are arranged to span tubular inner rod joining areas and meet each other in a loose manner. The mutual transverse play (5) of said inner rods determines the arch. To this end an internal support line holds together the arched section and the longer fixed rear rod.

3 Claims, 2 Drawing Sheets

SAIL BATTENS

TECNICAL FIELD

The invention relates to sail-battens with longish batten bars, which are positioned one behind the other and which are connected by bending joints in a way, that they can bend in relation to each other until a stop is hit.

STATE OF THE ART

The U.S. Pat. Ser. No. 2,378,877 characterises the state of the art, according to which the forces acting at the limiting stops are essentially directed in the longitudinal direction of the batten. This has the disadvantage, that the forces in the joints and at the stops must be very big, because the possible lever arm is only small.

DESCRIPTION OF THE INVENTION

The aim is a reliable, lightweight and not too expensive sail batten, which gets into the desired curvature already at minimal winds and which then keeps this widely also at strong winds. This aim is achieved by the characterising features of the claims. So, according to claim 1, FIGS. 1 to 7, 15, 16, the batten forces caused by the wind forces remain small, because the battens are about 100 times as long as they are wide, and because this is used to get long lever arms: With a length Ls of the batten bar of 5% of the length L of the sail batten and with a length of the lever arm of half of the length of the respective batten bar or of the width B of the known batten joints it follows, that the forces at the inventive batten are less than the 0,5 B/0,5 Ls=0.5×0.01 L/0.5×0.05 L=0.2 fold, i.e. less than 20% of the value at the known constructions. Moreover, because of the large distance between the stops, the dimensional accuracy becomes less essential. Moreover, the usual, highly stressed bending joints may be dismissed, because the batten bars 1 and the overlapping bars (way limiting members) 2 limit themthelves by a clearance their transverse movements and by this their relative bending movements.

BRIEF DESCRIPTION OF THE DRAWINGS

FIGS. 1 to 4, makes possible a simple construction by the fact, that the tube batten bars 1 enclose the tube shaped overlapping bars (way limiting members) 2.

FIGS. 5, 6, 11 to 16, allows for the use of the commercial flat batten profiles, which, due to their small thickness at the necessary strength (section modulus), make possible a high flexibility. This protects against breakage at overload. Also, the same components may be used for the batten bars 1 and the overlapping bars of the way limiting members 2. The stops 6 of the way limiting members 2 may be hold seperately, as in FIG. 6, or be hold by the bars.

The invention makes possible a simple way to adjust the curvature of the batten, since the length of the overlapping determines the angle between the bars.

The rigid bars make possible an optimal curvature in a simple way. The high stiffness of the long rear rigid bar suppresses the fluttering of the rear part of the sail at storm. The simple rope with rope stops for the assembly of the profile parts to the sail batten. FIGS. 5 to 7, 11 to 14, requires only minimal expenditure.

Figure 1:
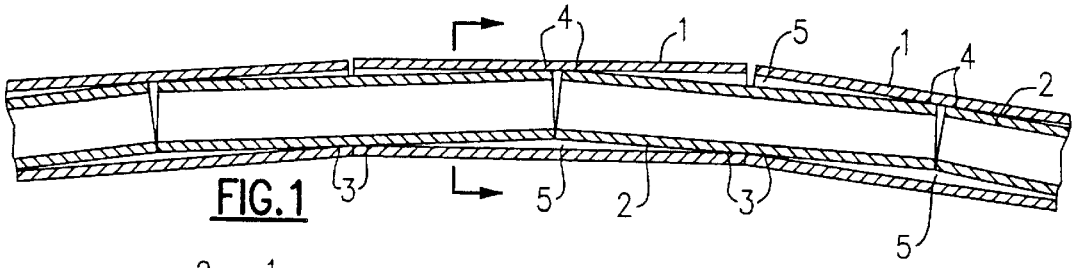
FIG. 1 shows a tube shaped batten from above.
Figure 2:
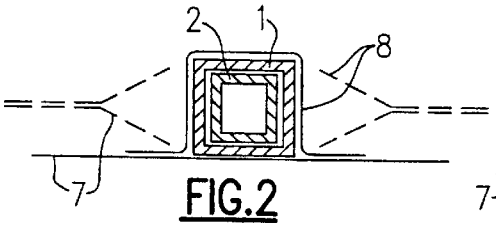
FIGS. 2–4 show different cross-sectional shaped for the batten of FIG. 1.
Figure 3:
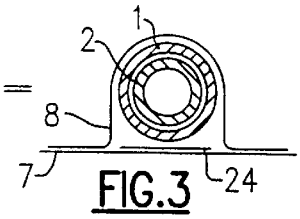
Figure 4:
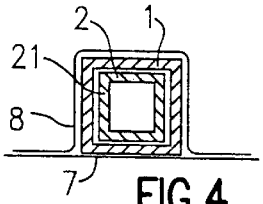
Figure 5:
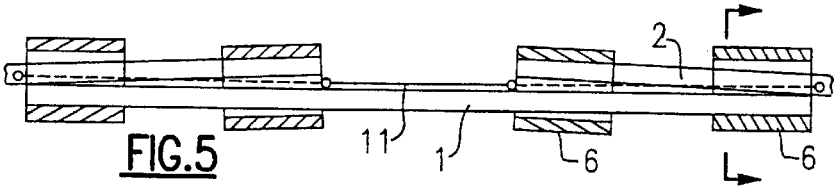
FIGS. 5, 6 and 11–16 show flat batten profiles.
Figure 6:
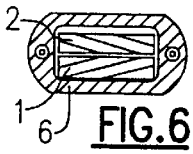
Figure 7:
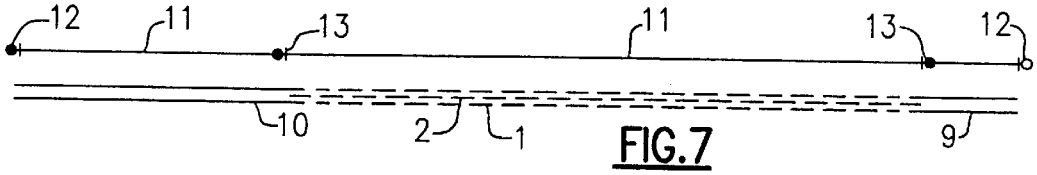
FIG. 7 shows a batten with rigid bars.
Figure 8:
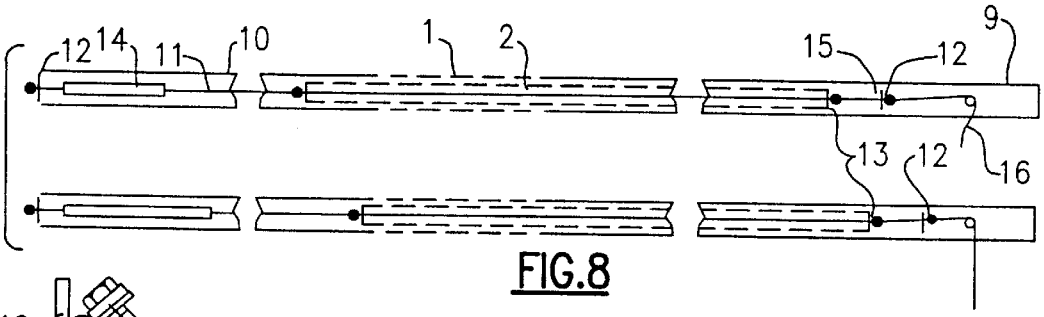
FIGS. 8 and 9 shows curvature adjustment.
Figure 9:
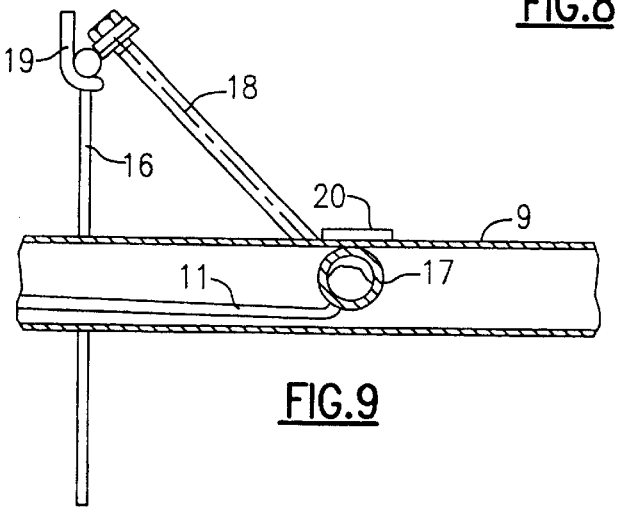
Figure 10:
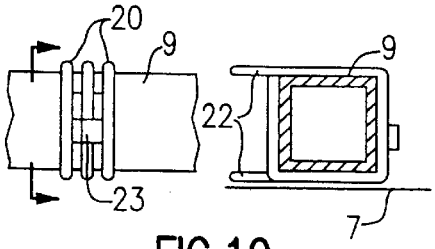
FIG. 10 is a cross-sectional view of FIG. 9.
Figure 11:
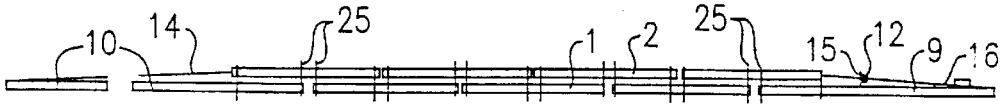
Figure 12:
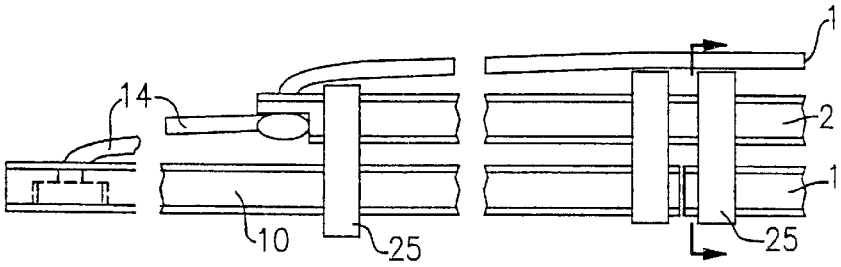
Figure 13:
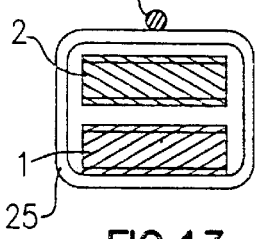
Figure 14:
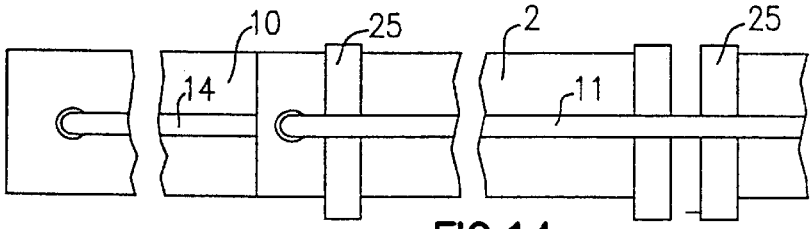
Figure 15:
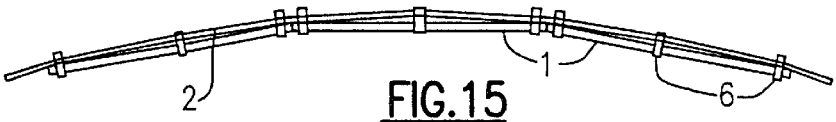
Figure 16:
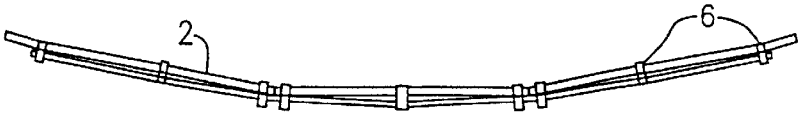

FIG. 1 shows a tube shaped batten in a longitudinal cur see from above, FIGS. 2, 3 and 4 different possibilities of the cross-section. hold in the sail 7 and sall-pocket 8. FIG. 5 shows from above, FIG. 6 the cross section of a construction with flat batten bars 1 and way limiting members 2.6 out of likewise flat overlapping bars 2 and ring shaped stops 6, FIG. 7 shows a batten with rigid bars and above the holding rope and batten stops. FIG. 8 shows the simple adjustment of the curvature above in the basic position, beneath with the adjustment rope drawn. FIG. 9 shows the curvature adjustment which is simple, but requires big longitudinal forces, with shaft 17, lever 18, spring (elastic) rope 19 and stop plate 20. The profiles FIGS. 4 and 10, have a large touching area between the bars and make possible an especially simple and reliable curvature adjustment. The equalizing batten 24 after FIG. 3, allows to use only few long batten bars, which makes possible a reliable curvature adjustment without enlarging by this the stop forces.

COMMERCIAL USE

Sail battens.

What is claimed is:

1. A batten assembly for use in association with a sail that includes an elongated member having a front side and an opposed back side, said elongated member being made up of contiguously mounted batten bars with a joint being formed in a region between adjacent batten bars, and stop means located at each joint for limiting the lateral movement of the batten bars within the joint region wherein each batten bar can be angularly displaced to either side of said elongated member in order to change the shape of said member and in which one end of each batten bar overlies an end of an adjacent batten bar.

2. A batten assembly for use in association with a sail that includes an elongated member having a front side and an opposed back side, said elongated member being made up of contiguously mounted batten bars with a joint being formed in a region between adjacent batten bars, and stop means located at each joint for limiting the lateral movement of the batten bars within the joint region wherein each batten bar can be angularly displaced to either side of said elongated member in order to change the shape of said member and in which said stop means includes an annular member that surrounds adjacent batten bars within the joint region.

3. A batten assembly for use in association with a sail that includes an elongated member having a front side and an opposed back side, said elongated member being made up of contiguously mounted batten bars with a joint being formed in a region between adjacent batten bars, and stop means located at each joint for limiting the lateral movement of the batten bars within the joint region wherein each batten bar can be angularly displaced to either side of said elongated member in order to change the shape of said member and in which each batten bar is a tubular element and the tubular elements are mounted in an end to end configuration and wherein said stop means further includes a series of rods that are contained within adjacent tubular elements so that each rod passes through said joint region between the batten bars.

* * * * *